United States Patent [19]

Hamanaga

[11] Patent Number: 4,970,932

[45] Date of Patent: Nov. 20, 1990

[54] STRUCTURE OF ROTARY VALVE ASSEMBLY USED IN WIND INSTRUMENT

[75] Inventor: Shinji Hamanaga, Shizuoka, Japan

[73] Assignee: Yamaha Corporation, Hamamatsu, Japan

[21] Appl. No.: 347,204

[22] Filed: May 4, 1989

[30] Foreign Application Priority Data

May 6, 1988 [JP] Japan ..... 63-110863

[51] Int. Cl.[5] ..... G10D 9/04

[52] U.S. Cl. ..... 84/390; 84/392

[58] Field of Search ..... 84/390, 392

[56] References Cited

U.S. PATENT DOCUMENTS

| | | | |
|---|---|---|---|
| 1,244,745 | 10/1917 | King | 84/390 |
| 2,003,995 | 6/1935 | Einhorn | 84/392 |
| 3,641,863 | 2/1972 | Kanstul et al. | 84/390 |
| 3,973,464 | 8/1976 | Novy | 84/392 |
| 4,112,806 | 9/1978 | Thayer | 84/390 |

FOREIGN PATENT DOCUMENTS

| | | | |
|---|---|---|---|
| 114573 | 4/1929 | Fed. Rep. of Germany | 84/390 |
| 2918247 | 8/1980 | Fed. Rep. of Germany | 84/390 |

*Primary Examiner*—Lawrence R. Franklin

*Attorney, Agent, or Firm*—Burns, Doane, Swecker & Mathis

[57] ABSTRACT

A rotary valve assembly incorporated in a brass instrument for changing a pitch of a tone comprises a rotary valve housed in a valve casing having two groups of aeroports, and the rotary valve is provided with two air passages, one of which interconnects the aeroports in the first group and the other of which interconnects one aeroport of the first group and one aeroport of the second group, so that various arrangements are possible for the aeroports.

5 Claims, 12 Drawing Sheets

STRUCTURE OF ROTARY VALVE ASSEMBLY USED IN WIND INSTRUMENT

FIELD OF THE INVENTION

This invention relates to a wind instrument and, more particularly, to a rotary valve assembly incorporated in, for example, a brass instrument so as to change a wind path for an air flow produced by the player's breath.

DESCRIPTION OF THE RELATED ART

The brass instrument such as a trumpet, a horn, a trombone or a tuba largely comprises a mouthpiece, a tube member coupled to the mouthpiece and having an air conduit for providing a column of air, and a plurality of valve members respectively associated with keys and provided in the tube member. Each of the valve members is provided with one or more air passages selectively coupled to the air conduit depending upon the associated key motion and, accordingly, changes the pitch of vibration of the column of air, thereby allowing the different tone to be produced.

One of the prior art valve assemblies incorporated in the brass instrument is provided with a rotary valve 1 housed in a valve casing (not shown), and the rotary valve 1 is generally shaped into a column configuration as shown in FIGS. 1 and 2. The rotary valve has two lug portions 2 and 3 rotatably supported by the valve casing and is constricted in the middle to form two air passages 4 and 5. Though not shown in the drawings, the valve casing has aeroports selectively coupled through the air passages 4 and 5. Namely, when the player depresses the associated key, the rotary valve 1 is driven for rotation around the center axis 6, and, accordingly, the aeroports are selectively coupled through the air passages 4 and 5 or blocked by the rotary valve 1. Since the aeroports are coupled to the air conduit formed in the tube member, the column of air is changed in volume for varying the pitch of the tone. Since the air passages 4 and 5 are formed in the central portion of the rotary valve 1 in a back to back arrangement, the aeroports should be formed around the center axis 6, and the respective center axes thereof should be arranged on a virtual plane 7 which is substantially perpendicular to the center axis 6.

Turning to FIG. 3 of the drawings, there is shown another rotary valve 11. The rotary valve 11 is constricted twice to provide two pairs of air passages 12, 13, 14 and 15 and has two lug portions 16 and 17. The lug portions 16 and 17 are rotatably supported by a valve casing (not shown), and the two pairs of air passages 12 to 15 simultaneously couple aeroports formed in the valve casing. Each pair of air passages is also arranged in a back to back arrangement, so that the aeroports should be disposed in the juxtaposition and the two groups of the center axes be arranged on virtual planes 18 and 19, respectively, which are substantially perpendicular to a center axis 20 of the rotary valve 11.

Still another prior art rotary valve 21 is illustrated in FIGS. 4 and 5 and generally shaped into a column configuration. The rotary valve 21 is characterized by a curved air passage 22 which is open at both ends thereof to the circumferential surface of the rotary valve 21. The rotary valve 21 is associated with two lug portions 23 and 24 supported by a valve casing (not shown), and aeroports formed in the valve casing are selectively coupled through the curved air passage 22 or blocked by the rotary valve 21 depending upon the angular position of the rotary valve 21. The center line of the air passage 22 is on a virtual plane 25, and, accordingly, the center axes of the aeroports should be radially arranged on the virtual plane 25.

FIG. 6 shows still another prior art rotary valve 31 which is provided with two air passages 32 and 33. Both of the air passages 32 and 33 are open to the circumferential surface of the rotary valve 31 but different in angular position from one another. The centers of the air passages 32 and 33 are respectively located on virtual planes 34 and 35, so that the aeroports are grouped into two, and all aeroports in each group should be arranged in such a manner that the center axes thereof be radially disposed on the virtual plane 34 or 35.

Turning to FIGS. 7 and 8, still another rotary valve 41 has a generally column configuration accompanied with a lug portion 42 projecting from the bottom surface of the column shaped rotary valve 41. An air passage 43 is opened at one end thereof into the top surface of the rotary valve 41 and at the other end thereof into the circumferential surface of the rotary valve 41 and, accordingly, curved at a right angle. By virtue of this arrangement, aeroports formed in a valve casing (not shown) can be disposed in such a manner that the center axes thereof are on respective planes substantially perpendicular to each other. In the valve casing the rotary valve 41 is paired with another rotary valve of the same type and steers an air flow in cooperation with the rotary valve paired therewith.

A rotary valve incorporated in still another rotary valve assembly is illustrated in FIGS. 9 and 10. The rotary valve 51 shown in FIGS. 9 and 10 has a generally column shaped configuration, and two lug portions 52 and 53 project from the top and bottom surfaces of the column shaped rotary valve 51. The rotary valve 51 is partially cut away to form two air passages 54 and 55, and the two air passages 54 and 55 are opened into the circumferential surface of the rotary valve 51 in a back to back fashion. Though not shown in the drawings, aeroports formed in a valve casing (not shown) have respective center axes provided on a virtual plane 56 in correspondence with the air passages 54 and 55.

Turning to FIGS. 11 and 12, still another rotary valve 61 is shaped into a generally frusto-conical configuration and has a lug portion 65 projecting from the bottom surface of the generally frusto-conical rotary valve 61. In this prior art example, two air passages 62 and 63 are formed in the rotary valve 61, and the air passage 63 is opened at one end thereof to the bottom surface of the rotary valve and at the other end thereof to the circumferential surface of the rotary valve 61. On the other hand, the air passage 62 has openings one of which is open to the bottom surface and the other of which is open to the top surface. Each of the air passages 62 and 63 is coupled to an aeroport open to the bottom surface, however, other aeroports are open to either top or circumferential surface. The other aeroports should be arranged in such a manner as to allow the center axes thereof to be on a virtual plane 64.

However, a problem is encounted in the rotary valve assemblies shown in FIGS. 1 to 6, 9 and 10 with respect to the arrangement of the aeroports. Namely, each of the air passages merely interconnects the aeroports with the center axes extending on the virtual plane, and, for this reason, any deviation of the aeroports from the virtual plane is not allowed. This results in being imposed on the arrangement of the aeroports.

Moreover, another problem is encountered in the rotary valve assemblies respectively shown in FIGS. 7 and 8 and FIGS. 11 and 12 with respect to their-complex structure. Namely, since the rotary valves are of the cantilever type, the bearing mechanism of the valve casing is complicated, and, accordingly, the assemblage of the rotary valve requires time-consuming and elaborate labor.

SUMMARY OF THE INVENTION

It is therefore an important object of the present invention to provide a rotary valve assembly which couples aeroports deviated from each other.

It is also an important object of the present invention to provide a rotary valve assembly which is easy for assemblage.

To accomplish these objects, the present invention proposes to provide not only an air passage extending on a virtual plane substantially perpendicular to the rotational axis of the rotary valve but also an air passage obliquely extending with respect to the virtual plane.

In accordance with the present invention, there is provided a rotary valve assembly incorporated in a brass instrument for changing the pitch of a toner produced by a player's breath, comprising: (a) a valve casing having a hollow space and provided with a plurality of aeroports; and (b) a rotary valve rotationally housed in the hollow space and having a first virtual plane substantially perpendicular to a rotational axis thereof and a plurality of air passages, in which at least one of the air passages obliquely extends with respect to the virtual plane but another air passage extends along the virtual plane and in which at least two of the aeroports have respective openings exposed to the hollow space and intersecting the virtual plane at different positions but another aeroport is exposed to the hollow space in an offset manner with respect to the virtual plane, wherein aforementioned one of the air passages couples aforementioned another aeroport to one of aforementioned two aeroports at a first angular position but aforementioned another air passage couples aforementioned two of the aeroports at a second angular position angularly spaced apart from the first angular position, one of the aforesaid valves having straight portions at both ends thereof, the rotary valve further having a second virtual plane substantially parallel to the first virtual plane, and another air passage extending along the second virtual plane to couple another two of the aeroports at the second angular position.

BRIEF DESCRIPTION OF THE DRAWINGS

The features and advantages of a rotary valve assembly according to the present invention will be more clearly understood from the following description taken in conjunction with the accompanying drawings in which.

DESCRIPTION OF THE PREFERRED EMBODIMENTS

First Embodiment

Figure 1:
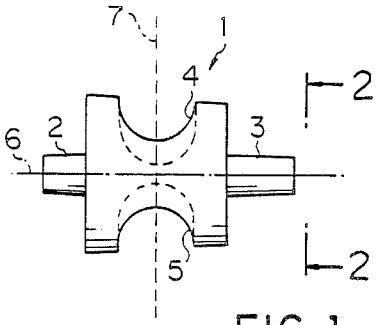
FIG. 1 PRIOR ART
FIG. 1 is a front view showing the rotary valve forming part of a prior art rotary valve assembly.
Figure 2:
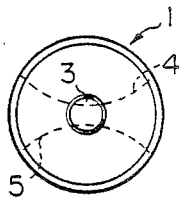
FIG. 2 PRIOR ART
FIG. 2 is a side view showing the rotary valve in the direction indicated by section line 2—2 in FIG. 1.
Figure 3:
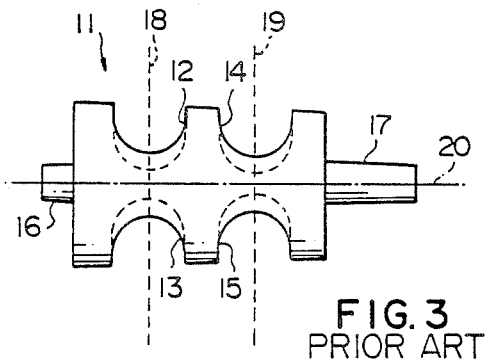
FIG. 3 PRIOR ART
FIG. 3 is a front view showing the rotary valve forming part of another prior art rotary valve assembly.
Figure 4:
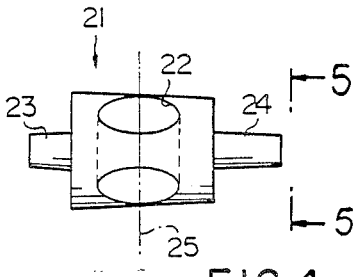
FIG. 4 PRIOR ART
FIG. 4 is a front view showing the rotary valve incorporated in still another prior art rotary valve assembly.
Figure 5:
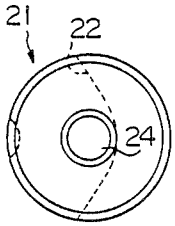
FIG. 5 PRIOR ART
FIG. 5 is a side view showing the rotary valve in the direction indicated by section line 5—5 in FIG. 4.
Figure 6:
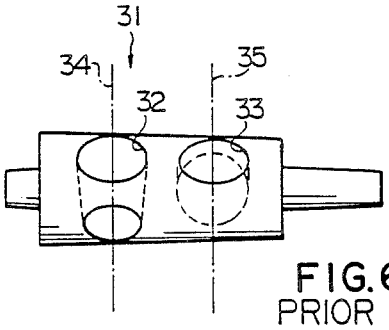
FIG. 6 PRIOR ART
FIG. 6 is a front view showing the structure of the rotary valve incorporated in still another rotary valve assembly.
Figure 7:
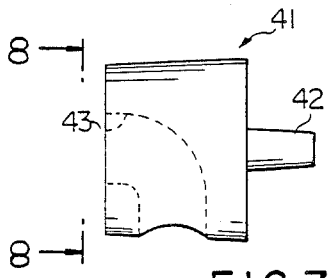
FIG. 7 PRIOR ART
FIG. 7 is a front view showing the structure of the rotary valve incorporated in still another rotary valve assembly.
Figure 8:
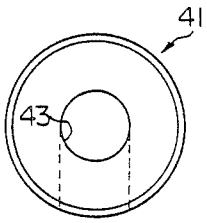
FIG. 8 PRIOR ART
FIG. 8 is a side view showing the rotary valve in the direction indicated by section line 8—8 in FIG. 7.
Figure 9:
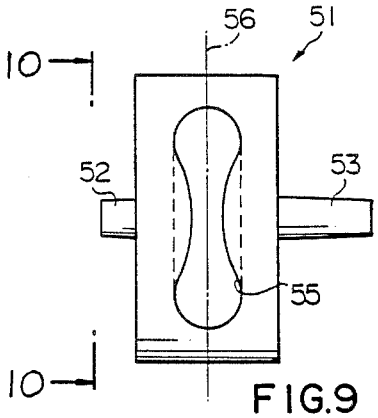
FIG. 9 PRIOR ART
FIG. 9 is a front view showing the structure of still another prior art rotary valve.
Figure 10:
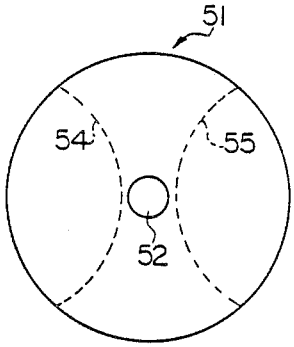
FIG. 10 PRIOR ART
FIG. 10 is a side view showing the rotary valve in the direction indicated by section line 10—10 in FIG. 9.
Figure 11:
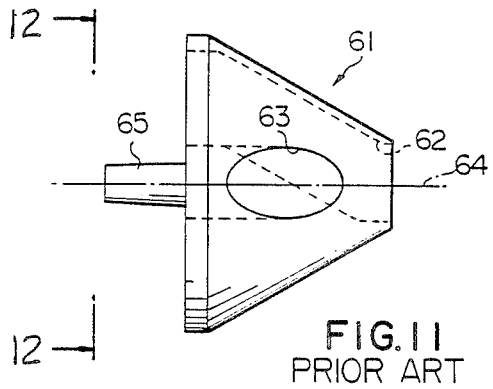
FIG. 11 PRIOR ART
FIG. 11 is a front view showing the structure of the rotary valve forming part of still another prior art rotary valve assembly.
Figure 12:
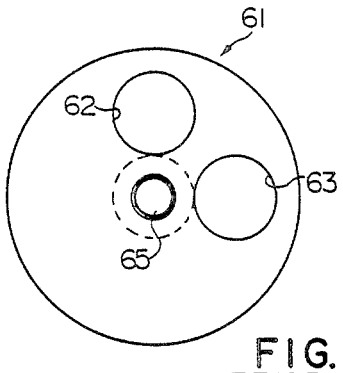
FIG. 12 PRIOR ART
FIG. 12 is a side view showing the rotary valve in the direction indicated by section line 12—12 in FIG. 11.
Figure 13:
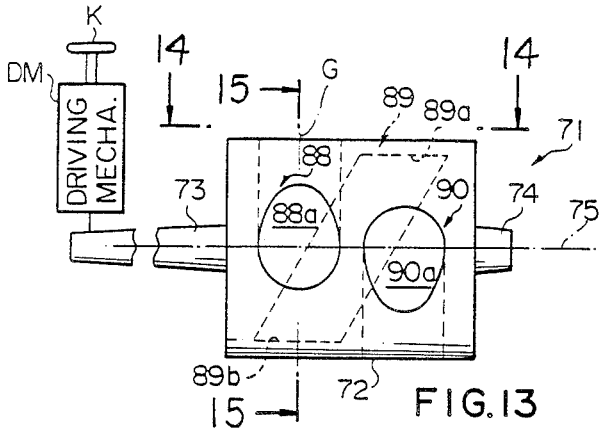
FIG. 13 is a plan view showing the structure of a rotary valve incorporated in a rotary valve assembly embodying the present invention.
Figure 14:
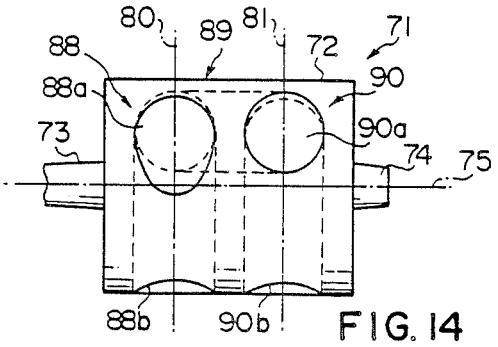
FIG. 14 is a view showing the rotary valve in the direction indicated by section line 14—14 in FIG. 13.
Figure 15:
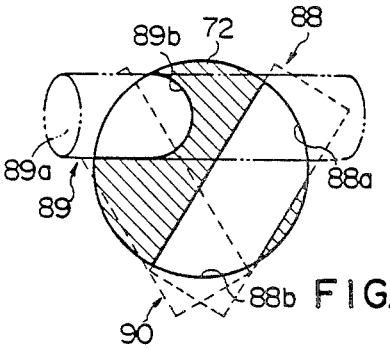
FIG. 15 is a cross sectional view taken along and in the direction of section line G 15—15 in FIG. 13.

Referring first to FIGS. 13 to 15, a rotary valve 71 largely comprises a rotor 72 with a generally column shaped configuration and two lug portions 73 and 74 projecting from both side surfaces of the rotor 72. The lug portions 73 and 74 have respective rotational axes which are aligned with the center axis of the rotor 72, thereby providing a center axis 75 of the rotary valve 71. The rotary valve 71 is associated with a driving mechanism DM coupled to a key member K, and the driving mechanism DM transmits the key motion to the rotary valve 72 for rotation upon a depression of the key K. The driving mechanism DM is by way of example formed by linkages coupled between the key member K and the rotary valve 71.

Figure 16:
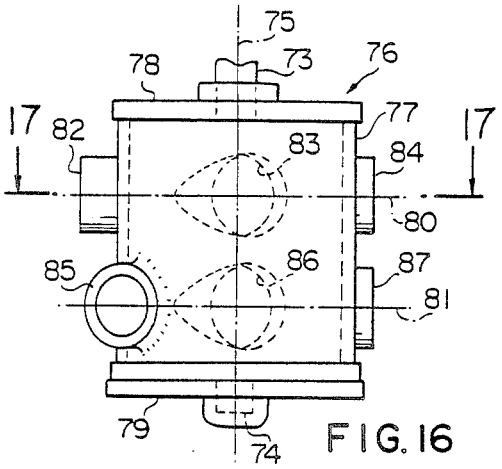
FIG. 16 is a plan view showing the structure of a rotary valve assembly in which the rotary valve shown in FIG. 13 is incorporated.
Figure 17:
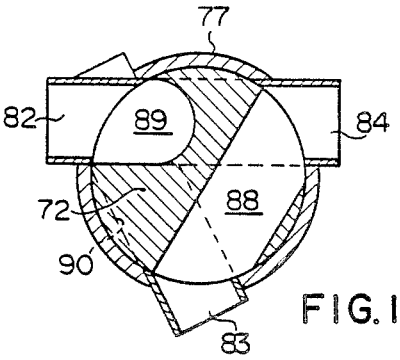
FIG. 17 is a cross sectional view taken along the virtual plane 80 and showing the rotary valve assembly in the direction indicated by section line 17—17 in FIG. 16.

Turning to FIGS. 16 and 17 of the drawings, there is shown a valve casing 76 which largely comprises a bulge portion 77, and two supporting plate members 78 and 79 attached to both sides of the bulge portion 77. The rotary valve 71 and the valve casing 76 as a whole constitute a rotary valve assembly. The rotor 72 is housed in the bulge portion 77, and the two lug portions 73 and 74 are journaled at the supporting plate members 78 and 79, respectively. Assuming now that two virtual planes 80 and 81 are provided for the rotary valve assembly and are substantially perpendicular to the center axis 75 of the rotary valve 71, two groups of aeroports 82, 83, 84, 85, 86 and 87 are formed in the bulge portion 77, and each of the aeroport groups is provided on the virtual planes 80 and 81, respectively. Namely, the first group of aeroports 82, 83 and 84 have respective center axes angularly spaced apart from one another by about 120 degrees on the virtual plane 80. Similarly, three center axes of the aeroports 85, 86 and 87 are angularly spaced apart by about 120 degrees on the virtual plane 81.

Turning back to FIGS. 13 to 15, three air passages 88, 89 and 90 are formed in the rotor 72, and the two air passages 88 and 90 have respective center axes rotatable on the virtual planes 80 and 81, respectively, however, a center axis of the third air passage 89 extends across the virtual planes 80 and 81. In detail, the first air passage 88 has two openings **88*a* and 88*b* the centers of which are provided on the virtual plane 80, and the second air passage 90 is terminated at both openings 90*a* and 90*b* the center of which are provided on the virtual plane 81. However, the third air passage 89 has two openings 89*a* and 89*b* having respective centers on the virtual planes 80 and 81. If the air passages 88 to 90 are projected onto the virtual plane 80, the air passages are intersected at about 60 degrees as will be understood from FIG. 15. The aeroports 82 to 87 and the air passages 88 to 90** thus arranged are selectively coupled to one another for estabilishing air conduits.

Figure 18:
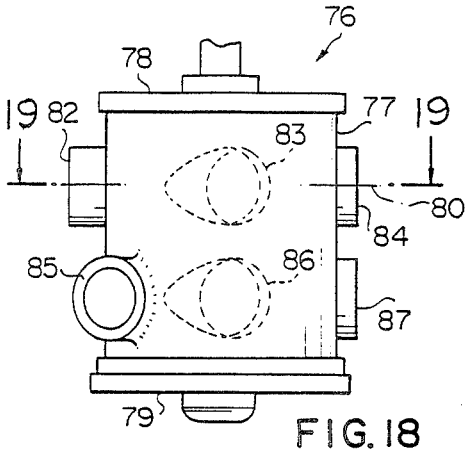
FIG. 18 is a plan view showing the rotary valve assembly illustrated in FIG. 16.
Figure 19:
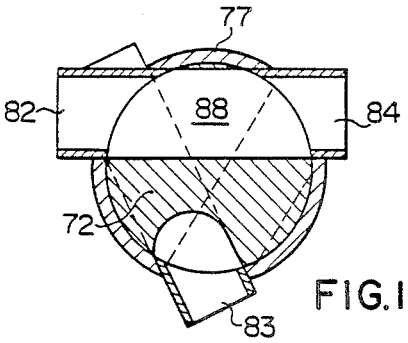
FIG. 19 is a cross sectional view taken along the virtual plane 80 of FIG. 18 and showing the rotary valve assembly in the direction indicated by section line 19—19 where the rotary valve is different in angular position from that shown in FIG. 17.

When the rotary valve 71 is maintained in a first angular position, the air passage 88 interconnects the aeroports 83 and 84, and the air passage 89 couples the aeroport 82 with the aeroport 87. In the first angular position, the air passage 90 connects the aeroport 85 to the aeroport 86. However, if the rotary valve 71 is rotated about 120 degrees to be shifted into a second angular position, the air passage 88 couples the aeroport 82 to the aeroport 84, and, on the other hand, the air passage 89 interconnects the aeroports 83 and 85. Moreover, the air passage 90 couples the aeroport 86 to the aeroport 87 as shown in FIGS. 18 and 19.

The rotary valve assembly thus arranged is incorporated in a rotary trumpet, an air flow produced by the player's breath is guided by the air passages 88 to 90 depending upon the angular position of the rotary valve 71. For example, when the rotary valve 71 is shifted to the first angular position, the air flows from the mouthpiece through the aeroport 82, the air passage 89, the aeroport 87, the aeroport 86 and the air passage 90 to the aeroport 85. However, if the rotary valve 71 turns into the second angular position, the air flows from the aeroport 82 through the air passage 88, the aeroport 84, the aeroport 83 and the air passage 89 into the aeroport 85.

Figure 20A:
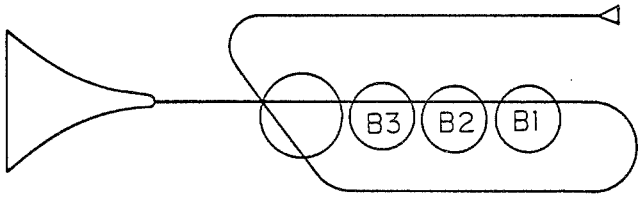
FIGS. 20A and 20B are views showing, in modeled form, French horns incorporated with the rotary valve assembly illustrated in FIGS. 13 to 19.
Figure 20B:
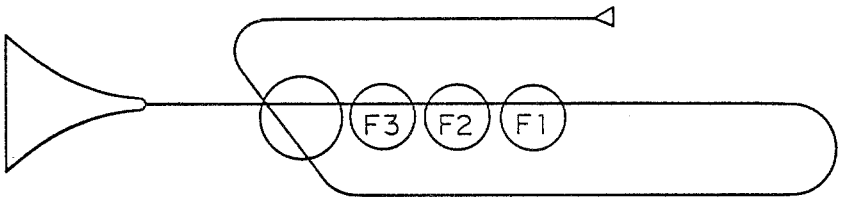

The rotary valve assembly illustrated in FIGS. 13 to 19 is applicable to another brass instrument such as, for example, a French horn. FIG. 20A shows a B♭ French horn, and FIG. 20B shows an F French horn, both French horns provide respective air conduits passing through three rotary valve assemblies B1 to B3 and F1 to F3.

Second Embodiment

Figure 21:
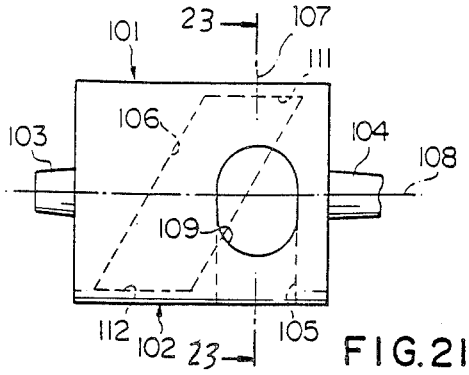
FIG. 21 is a plan view showing the structure of a rotary valve incorporated in another rotary valve assembly embodying the present invention.
Figure 22:
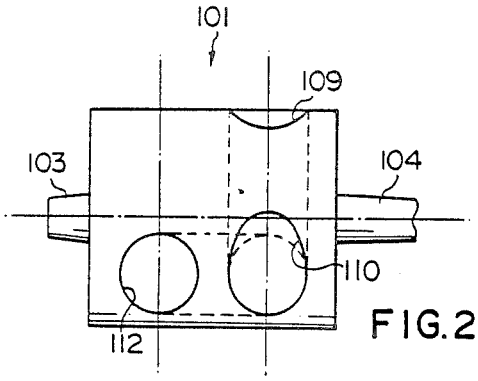
FIG. 22 is a front view showing the structure of the rotary valve shown in FIG. 21.
Figure 23:
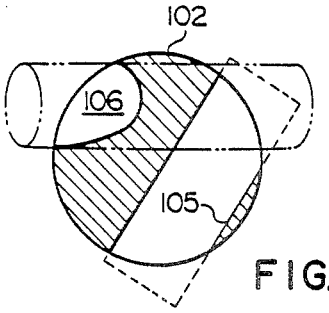
FIG. 23 is a cross sectional view taken along the virtual plane 107 and showing the structure in the direction indicated by section line 23—23 in FIG. 21.

Turning to FIG. 21 to 23, another rotary valve 101 embodying the present invention is illustrated and comprises a rotor 102, and two lug portions 103 and 104, and two air passages 105 and 106 are formed in the rotor 102. One of the air passages 105 and 106 has a center axis extending on a virtual plane 107 substantially perpendicular to a rotational axis 108 of the rotary valve 102, and two openings thereof 109 and 110 are opened to the circumferential plane of the rotor 102. However, the other air passage 106 obliquely extends with respect to the rotational axis 108, and one of the openings of the air passage 106 intersects the virtual plane 107. However, the other opening of the air passage 106 is offset from the virtual plane 107.

Figure 24:
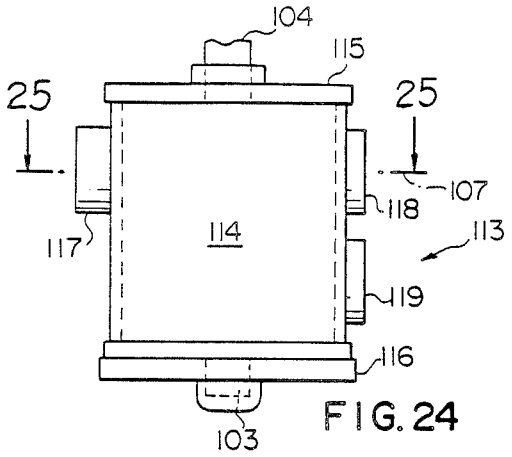
FIG. 24 is a plan view showing the rotary valve assembly incorporated with the rotary valve illustrated in FIG. 21.
Figure 25:
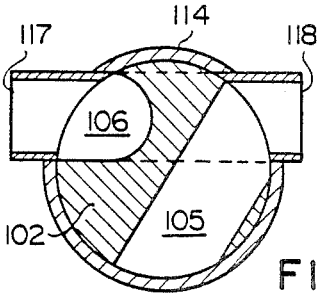
FIG. 25 is a cross sectional view taken along the virtual plane 107 and showing the structure in the direction indicated by section line 25—25.

The rotary valve 101 is housed in the valve casing 113 which is illustrated in FIGS. 24 an 25. The valve casing 113 largely comprises a bulge portion 114 and two supporting plate members 115 and 116, and three aeroports 117, 118 and 119 are provided on the bulge portion 114. The rotor 102 is inserted into the bulge portion 114, and the lug portions 103 and 104 are supported by the supporting plate members 115 and 116, respectively, in a rotatable manner. The aeroports 117 and 118 pass through the bulge portion 114 and have respective center axes extending on the virtual plane 107, however, the other air port 119 is spaced apart from the virtual plane 107 by a distance approximately equal to that between the openings 109 and 112. As will be better understood from FIG. 25, when the aeroports are projected onto the virtual plane 107, the aeroports are angularly spaced apart from one another by about 120 degrees.

Figure 26:
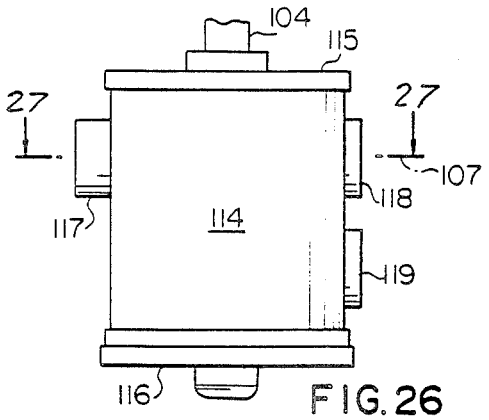
FIG. 26 is a plan view showing the rotary valve assembly shown in FIG. 24.
Figure 27:
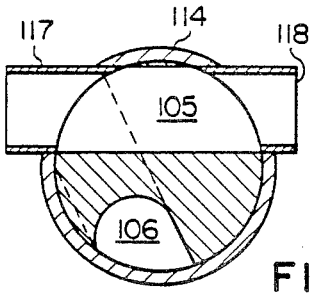
FIG. 27 is a cross sectional view taken along the virtual plane 107 and showing the structure in a different angular position in the direction indicated by section line 27—27 in FIG. 26.

The rotary valve assembly thus arranged provides an air conduit from the aeroport 117 through the air passage 106 to the aeroport 119 in a first angular position. In this first angular position, the air produced by the player's breath flows from the aeroport 117 through the air passage 106 to the aeroport 119. However, if the rotary valve is driven for rotation and shifted into a second angular position, the aeroport 117 is coupled through the air passage 105 to the aeroport 118 as shown in FIGS. 26 and 27. In the second angular position, the air is guided by the air passage 105 to the air port 118, so that the rotary valve assembly is operative to change the route for the air depending upon the angular position. If the aeroport 118 is coupled to a bypass tube, the column of air is varied to change the pitch of the tone produced.

Figure 28A:
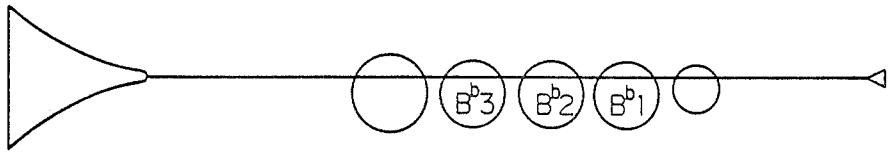
FIGS. 28A and 28B are views showing, in a modeled form, French horns in which the rotary valve assembly shown in FIG. 24 is incorporated.
Figure 28B:
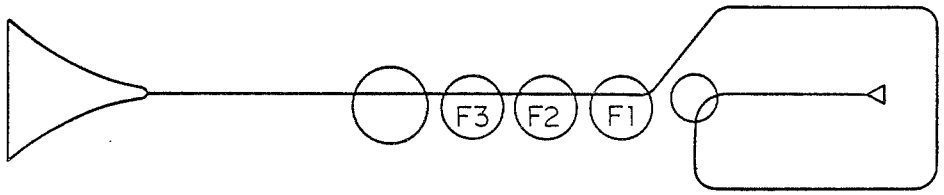

FIGS. 28A and 28B show French horns one of which is of the B♭ tube and the other of which is of the F tube. Each of the French horns is provided with three rotary valve assemblies for changing the pitch of the toner produced by the player's breath.

Although particular embodiments of the present invention have been shown and described, it will be obvious to those skilled in the art that various changes and modifications may be made without departing from the spirit and scope of the present invention. For example, the air passage 89 of the first embodiment straightly extends in the rotor 72, however, the air passage may be curved in the rotor to avoid undersirable intersection between the air passages. In another implementation, the rotor is formed by a tube member with a plurality aeroports, and internal tubes couple the aeroports for providing the air passages. In this instance, the rotary valve assembly is reduced in weight, and, accordingly, the player easily holds the brass instrument.

What is claimed is:

1. A rotary valve assembly incorporated in a brass instrument for changing the pitch of a tone produced by a player's breath, comprising:

a valve casing having a hollow space and provided with a plurality of aeroports; and a rotary valve rotatably housed in said hollow space and having a first virtual plane substantially perpendicular to a rotational axis thereof and a plurality of air passages, at least one of said air passages extending obliquely with respect to said first virtual plane and another of said air passages extending along said first virtual plane, at least two of said aeroports having respective openings exposed to said hollow space and intersecting said first virtual plane at different positions, another aeroport being exposed to the hollow space in an offset manner with respect to said first virtual plane, said at least one air passage coupling said another aeroport to one of said at least two aeroport when said rotary valve is located in a first angular position, said another air passage coupling said at least two aeroports when said rotary valve is located in a second angular position angularly spaced apart from said first angular position, said at least one air passage having straight portions at both ends thereof, said rotary valve including a second virtual plane that is substantially parallel to said first virtual plane, a further air passage extending along said second virtual plane and coupling two additional aeroports when said rotary valve is in the second angular position, said at least one air passage being located between said first and second virtual planes.

2. A rotary valve assembly as set forth in claim 1, in which said rotary valve further has two lug portions rotationally supported by said valve casing.

3. A rotary valve assembly as set forth in claim 2, in which one of said lug portions is coupled to a driving mechanism for transmitting a key motion upon depression of a key so as to drive said rotary valve for rotation between said first and second angular positions.

4. A rotary valve assembly incorporated in a brass instrument for changing the pitch of a tone produced by a player's breath, comprising:

a valve casing having a hollow space and provided with a plurality of aeroports; and a rotary valve rotatably positioned in said hollow space and having a first virtual plane substantially perpendicular to a rotational axis thereof and a plurality of air passages, at least one of said air passages extending straightly and obliquely with respect to said first virtual plane and another air passage extending along said first virtual plane, at least two of said aeroports having respective openings exposed to said hollow space and intersecting said first virtual plane at different positions, another one of said aeroports being exposed to the hollow space in an offset manner with respect to said first virtual plane, said at least one of said air passages coupling said another aeroport to one of said at least two aeroports when the rotary valve is in a first angular position, said another air passage coupling said at least two aeroports to one another when the rotary valve is in a second angular position angularly spaced apart from said first angular position, said rotary valve including a second virtual plane that is substantially parallel to said first virtual plane, an additional air passage extending along said second virtual plane and coupling two additional aeroports to one another when said rotary valve is in said second angular position, said at least one of said air passages being located between said first and second virtual planes.

5. A rotary valve assembly incorporated in a brass instrument for changing the pitch of a tone produced by a player's breath, comprising:

a valve casing having a hollow space and provided with first, second, third, fourth, fifth and sixth aeroports; and a rotary valve rotatably housed in said hollow space and having first and second virtual planes substantially perpendicular to a rotational axis thereof and first, second and third air passages, in which said third air passage extends obliquely between said first and second virtual planes, said first and second air passages extending along said first and second virtual planes respectively, said first, second and third aeroports having respective openings exposed to said hollow space and intersecting said first vitrual plane at different positions, said fourth, fifth and sixth aeroports being exposed to the hollow space and intersecting said second virtual plane, said second air passage interconnecting said first and third aeroports and said third air passage interconnecting said second and fourth aeroports when said rotary valve is in a first angular position, said first air passage interconnecting said fourth and fifth aeroports and said third air passage interconnecting said first and sixth aeroports when the rotary valve is in a second angular position angularly spaced apart from said first angular position.

* * * * *